US008311436B2

(12) United States Patent
Funayama et al.

(10) Patent No.: US 8,311,436 B2
(45) Date of Patent: Nov. 13, 2012

(54) IMAGE-FORMING APPARATUS AND IMAGE-FORMING METHOD FOR FORMING A DENSITY CORRECTION IMAGE

(75) Inventors: Hiroyuki Funayama, Kanagawa (JP); Naoki Hirako, Kanagawa (JP); Hideo Kimura, Kanagawa (JP); Keita Kumokiri, Kanagawa (JP); Shun Kuwahara, Kanagawa (JP); Izumi Suda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 372 days.

(21) Appl. No.: 12/635,450

(22) Filed: Dec. 10, 2009

(65) Prior Publication Data

US 2010/0329722 A1 Dec. 30, 2010

(30) Foreign Application Priority Data

Jun. 26, 2009 (JP) ..... 2009-152112

(51) Int. Cl.
*G03G 15/08* (2006.01)
*G03G 15/00* (2006.01)
*G03G 15/10* (2006.01)

(52) U.S. Cl. ..... 399/72; 399/29; 399/49; 399/59; 399/87; 399/160

(58) Field of Classification Search ..... 399/29, 399/49, 59, 72, 87, 160
See application file for complete search history.

(56) References Cited

U.S. PATENT DOCUMENTS 7,324,769 B2 * 1/2008 Yamaoka ..... 399/49

FOREIGN PATENT DOCUMENTS

JP 2006-138989 A 6/2006

* cited by examiner

*Primary Examiner* — Joseph S Wong
(74) *Attorney, Agent, or Firm* — Sughrue Mion, PLLC

(57) ABSTRACT

An image-forming apparatus includes: a forming unit that forms an image on an image holder that is a rotating body holding an image; a measuring unit that measures a rotation amount of the image holder with reference to a certain position on the image holder; a determining unit that: identifies a position on the image holder from which an image is to be formed by the forming unit, according to the rotation amount measured by the measuring unit; if, while a plurality of images are successively formed on the image holder, an image for density correction is to be formed, postpones forming of the image for density correction until a timing arrives at which one image of the plurality of images is to be formed from a predetermined position on the image holder, and when the timing arrives at which the one image of the plurality of images is to be formed from the predetermined position on the image holder, determines to start forming of the image for density correction from the predetermined position, instead of forming the one image of the plurality of images; and a correction unit that obtains a reading result of the image for density correction formed by the forming unit from the predetermined position, and corrects a density of at least one of the plurality of images on the basis of the obtained reading result.

3 Claims, 6 Drawing Sheets

310
320
330
340
1
2
3
4
5
6
7
8
9
10
11
12
13
14
15
16
17

310
320
330
340
1
2
3
4
5
6
7
8
9
10
11
12
13
14

310
320
330
340
1
2
3
4
5
6
7
8
9
10
11
12

310
320
330
340
1
2
3
4
5
6
7
8
9

IMAGE-FORMING APPARATUS AND IMAGE-FORMING METHOD FOR FORMING A DENSITY CORRECTION IMAGE

CROSS-REFERENCE TO RELATED APPLICATIONS

This application is based on and claims priority under 35 USC 119 from Japanese Patent Application No. 2009-152112 filed on Jun. 26, 2009.

BACKGROUND

Technical Field

The present invention relates to an image-forming apparatus and an image-forming method.

SUMMARY

According to an aspect of the invention, there is provided an image-forming apparatus including: a forming unit that forms an image on an image holder that is a rotating body holding an image; a measuring unit that measures a rotation amount of the image holder with reference to a certain position on the image holder; a determining unit that: identifies a position on the image holder from which an image is to be formed by the forming unit, according to the rotation amount measured by the measuring unit; if, while a plurality of images are successively formed on the image holder, an image for density correction is to be formed, postpones forming of the image for density correction until a timing arrives at which one image of the plurality of images is to be formed from a predetermined position on the image holder, and when the timing arrives at which the one image of the plurality of images is to be formed from the predetermined position on the image holder, determines to start forming of the image for density correction from the predetermined position, instead of forming the one image of the plurality of images; and a correction unit that obtains a reading result of the image for density correction formed by the forming unit from the predetermined position, and corrects a density of at least one of the plurality of images on the basis of the obtained reading result.

BRIEF DESCRIPTION OF THE DRAWINGS

Exemplary embodiment of the present invention will be described in detail based on the following figures, wherein.

DETAILED DESCRIPTION

(1) Configuration

Figure 1:
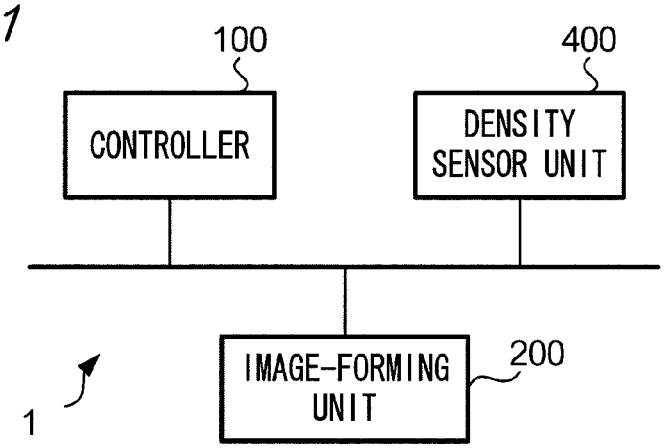
FIG. 1 is a block diagram that shows the configuration of an image-forming apparatus according to an exemplary embodiment.

FIG. 1 is a block diagram that shows the configuration of an image-forming apparatus 1 according to an exemplary embodiment of the invention. The image-forming apparatus 1 includes a controller 100, an image-forming unit 200, and a density sensor unit 400. The controller 100 includes a computing apparatus such as a CPU (Central Processing Unit) or an ASIC (Application Specific Integrated Circuit), and various memories, and controls operation of the image-forming apparatus 1. The image-forming unit 200 is an example of a forming unit that electrophotographically forms an image. Images formed by the image-forming unit 200 include images formed on a recording medium such as paper according to image information that the controller 100 has acquired from an external host apparatus or the like (hereinafter referred to as ordinary images), and images formed on an intermediate transfer belt described below in order to correct the density of the ordinary images (hereinafter referred to as density correction images). The density sensor unit 400 is, for example, an optical sensor, and reads the density of a density correction image formed by the image-forming unit 200, and supplies the results of that reading to the controller 100. The controller 100, in order to correct the density of images formed by the image-forming unit 200 based on those reading results, for example, corrects exposure conditions or a charging potential in the image-forming unit 200, or alternatively, corrects the contents of a look-up table for density correction.

Figure 2:
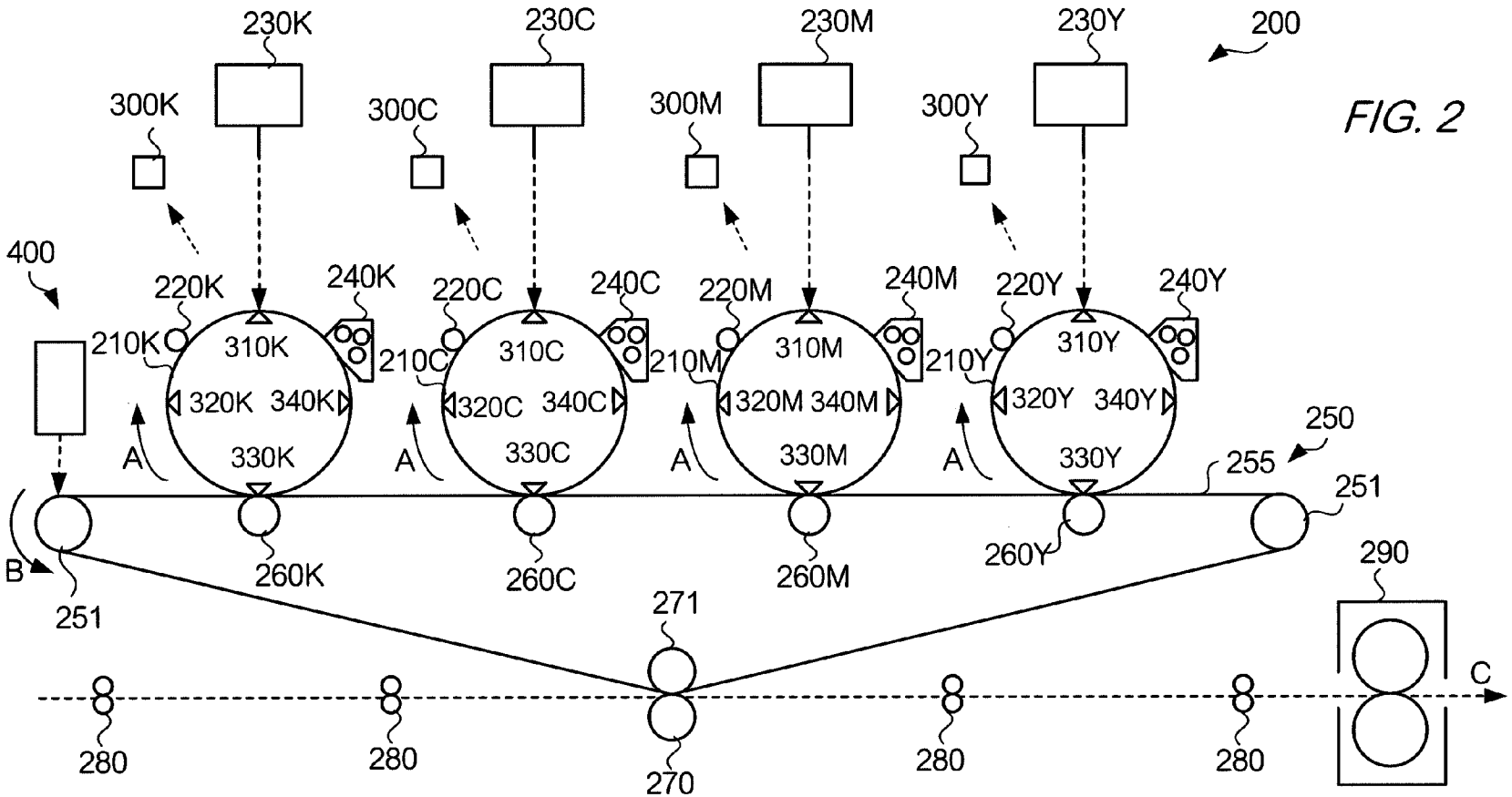
FIG. 2 shows the configuration of an image-forming unit and a density sensor unit included in the image-forming apparatus.

FIG. 2 shows the structure of the image-forming unit 200 and the density sensor unit 400. As shown in FIG. 2, the image-forming unit 200 includes photosensitive drums 210Y, 210M, 210C, and 210K, charging units 220Y, 220M, 220C, and 220K, exposing units 230Y, 230M, 230C, and 230K, development units 240Y, 240M, 240C, and 240K, a transfer unit 250, a fixing unit 290, and phase sensor units 300Y, 300M, 300C, and 300K. The transfer unit 250 has an intermediate transfer belt 255, multiple rotating rollers 251, primary transfer rollers 260Y, 260M, 260C, and 260K, a secondary transfer roller 270, a backup roller 271, and multiple delivery rollers 280. Among the reference numerals assigned to the configurations included in the image-forming unit 200, the reference numerals with a letter (Y, M, C, or K) appended indicate that the corresponding configuration is related to image-forming in a color corresponding to the letter. For example, the photosensitive drum 210Y, the charging unit 220Y, the exposing unit 230Y, and the development unit 240Y are for forming a Y (yellow) developer image in cooperation with the intermediate transfer belt 255. Note that M indicates magenta, C indicates cyan, and K indicates black. Furthermore, reference numerals that differ only by the appended letter have the same basic configuration, although their positions and the developer used are different. Below, when it is not particularly necessary to distinguish between such respective configurations, notation of Y, M, C, or K is omitted, as in the "photosensitive drums 210" or the "charging units 220".

The photosensitive drums 210 are cylindrical rotating bodies having a photoconductive film layered on their surface, and are an example of an image holder that holds an image. The photosensitive drums 210, when in a state contacting the intermediate transfer belt 255, are rotated in the direction of arrow A in FIG. 2 with the cylinder center as an axis, along with movement of the intermediate transfer belt 255. The charging unit 220 charges the photoconductive film of the photosensitive drums 210 to a predetermined potential. The exposing units 230 irradiate (i.e., expose) an amount of light controlled by the controller 100 on the charged photosensitive drums 210 to form an electrostatic latent image. The development units 240 develop the electrostatic latent image formed on the photosensitive drums 210 with a developer. The intermediate transfer belt 255 of the transfer unit 250 is an endless belt-like member, and moves so as to turn in the direction of arrow B in FIG. 2 while in contact with the rotating rollers 251, the primary transfer rollers 260, and the backup roller 271. The rotating rollers 251 are cylindrical members that support movement of the intermediate transfer belt 255, and rotate with a cylinder center as an axis.

The primary transfer rollers 260 are cylindrical members that face the photosensitive drums 210 while sandwiching the intermediate transfer belt 255, and produce a potential difference from the photosensitive drums 210 to transfer the image on the surface of the photosensitive drums 210 to the surface of the intermediate transfer belt 255. The secondary transfer roller 270 is a cylindrical member that faces the backup roller 271 while sandwiching the intermediate transfer belt 255, and produces a potential difference from the backup roller 271 to transfer the image on the surface of the intermediate transfer belt 255 to paper. The delivery rollers 280 are cylindrical members that carry paper to a position where the secondary transfer roller 270 performs transfer, and carry paper to which an image has been transferred to the position where the fixing unit 290 is provided. The fixing unit 290 applies heat and pressure to the paper to which an image has been transferred to fix the image on the paper. That is, a paper transport path is as indicated by arrow C with a broken line in FIG. 2. The density sensor unit 400 is provided at a position facing the intermediate transfer belt 255, and reads the density of a density correction image that has been formed on the surface of the intermediate transfer belt 255.

In the photosensitive drums 210Y, 210M, 210C, and 210K, in order to specify a position where an image is formed, markers referred to as placement phases are prescribed, such as origin placement phases 310Y, 310M, 310C, and 310K, second placement phases 320Y, 320M, 320C, and 320K, third placement phases 330Y, 330M, 330C, and 330K, and fourth placement phases 340Y, 340M, 340C, and 340K. The origin placement phases 310 are provided at one predetermined location of the photosensitive drums 210. The second placement phases 320 are provided at a position advanced by a center angle of 90° in the direction of reverse rotation of the photosensitive drums 210 from the origin placement phases 310. The third placement phases 330 are provided at a position advanced by a center angle of 180° in the direction of reverse rotation of the photosensitive drums 210 from the origin placement phases 310. The fourth placement phases 340 are provided at a position advanced by a center angle of 270° in the direction of reverse rotation of the photosensitive drums 210 from the origin placement phases 310.

The photosensitive drums 210 are manufactured such that they have properties as uniform as possible throughout their entire surface, but in the manufacturing process of the photosensitive drums 210 some amount of difference in film thickness occurs, and bias in properties of that surface occurs as a result of effects over time due to passing through many instances of the image-forming process, and thus a bias in charging properties or development properties may occur. Consequently, by the controller 100 starting formation of an ordinary image or a density correction image from any of the origin placement phase 310, the second placement phase 320, the third placement phase 330, or the fourth placement phase 340, effects of variation of properties of the surface of the photosensitive drum 210 as described above are suppressed as much as possible. For example, if the controller 100 forms ordinary images from the position of four phases, i.e. the origin placement phase 310, the second placement phase 320, the third placement phase 330, and the fourth placement phase 340, variation in image quality of the ordinary images is limited as much as possible to the four phases. On the other hand, the controller 100 starts formation of a density correction image from only any one (here, the origin placement phase 310) of the origin placement phase 310, the second placement phase 320, the third placement phase 330, and the fourth placement phase 340. In order to improve the accuracy of density correction, it is necessary to suppress as much as possible the effects of variation of the properties of the surface of the photosensitive drums 210, and so it is desirable to use a density correction image formed in a specific region of the photosensitive drums 210.

The phase sensor unit 300, for example, is a rotary encoder, and converts a rotation displacement amount of the photosensitive drums 210 to an electrical signal and supplies that signal to the controller 100. Based on this electrical signal, the controller 100 measures a rotation amount of the photosensitive drums 210 using the origin placement phase 310 as a reference, and specifies the rotational state of the photosensitive drums 210. That is, the phase sensor unit 300 and the controller 100 function as an example of a measuring unit that measures the rotation amount of the photosensitive drums 210, using a particular position (here, the origin placement phase) on the photosensitive drums 210 as a reference.

(2) Operation

Next is a description of operation in this exemplary embodiment.

FIGS. 3A to 3D illustrate, when successively forming multiple ordinary images, the relationship between placement phases and ordinary images on a photosensitive drum 210. On the horizontal axis in FIGS. 3A to 3D, one circumference of the photosensitive drum 210 is spread out, and the circumferential length of one circumference is successively joined for multiple circumferences.

Figures 3A, 3B, 3C, 3D:
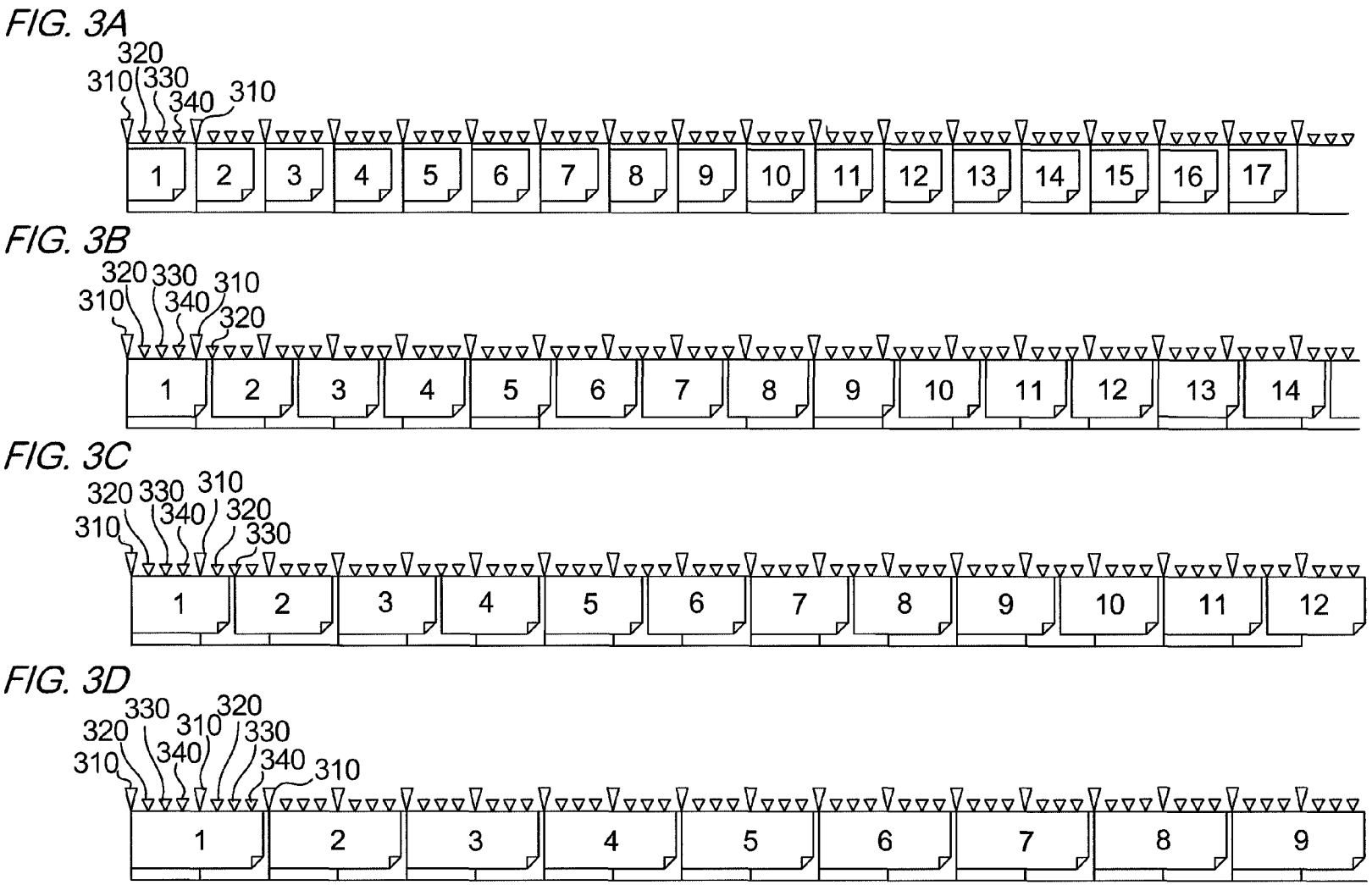
FIGS. 3A to 3D illustrate, when successively forming multiple images, the relationship between placement phases and images on a photosensitive drum.

FIG. 3A shows an example case in which the length in a sub-scanning direction (circumferential direction of the photosensitive drum 210) of an ordinary image is at least ¾ and less than one times the circumferential length of the photosensitive drum. This is referred to below as forming ordinary images at a 1 drum interval. In FIGS. 3A to 3D, an image indicated by "1" is an ordinary image initially formed in the photosensitive drum 210, and an image indicated by "2" is an ordinary image formed next in the photosensitive drum 210. This is likewise true for an image indicated by "3" and subsequent numbers. Also, in FIGS. 3A to 3D, corresponding to the image indicated by "1", reference numerals of the origin placement phase 310, the second placement phase 320, the third placement phase 330, and the fourth placement phase 340 are respectively added, and the positional relationship of these placement phases is the same for the images indicated by "2" or subsequent numbers. The same manner of representation as in FIG. 3 is also used in FIGS. 4 and 5.

As shown in FIG. 3A, when forming the ordinary image "1" that is formed first, the controller 100 starts that formation from the origin placement phase 310 of the photosensitive drum 210, and finishes that formation before the origin placement phase 310 of the next circumference. Likewise, when forming the ordinary image "2" that is formed second, the controller 100 starts that formation from the origin placement phase 310 of the photosensitive drum 210, and finishes that formation before the origin placement phase 310 of the next circumference. This is likewise true for the ordinary image "3" and subsequent ordinary images.

Next, FIG. 3B shows an example case in which ordinary images are formed at a 1.25 drum interval. As shown in FIG. 3B, when forming the ordinary image "1" formed first, the controller 100 starts that formation from the origin placement phase 310 of the photosensitive drum 210, and furthermore, exceeding one circumference of the photosensitive drum 210, finishes that formation before the second placement phase 320 of the second circumference. When forming the ordinary image "2" that is formed second, the controller 100 starts that formation from the second placement phase 320 of the second circumference of the photosensitive drum 210, and finishes that formation before the third placement phase 330 of the third circumference. This is likewise true for the ordinary image "3" and subsequent ordinary images.

Next, FIG. 3C shows an example case in which ordinary images are formed at a 1.5 drum interval. As shown in FIG. 3C, when forming the ordinary image "1" that is formed first, the controller 100 starts that formation from the origin placement phase 310 of the photosensitive drum 210, and furthermore, exceeding one circumference of the photosensitive drum 210, finishes that formation before the third placement phase 330 of the second circumference. When forming the ordinary image "2" that is formed second, the controller 100 starts that formation from the third placement phase 330 of the second circumference of the photosensitive drum 210, and finishes that formation before the origin placement phase 310 of the fourth circumference. This is likewise true for the ordinary image "3" and subsequent ordinary images.

FIG. 3D shows an example case in which ordinary images are formed at a 2 drum interval. As shown in FIG. 3D, when forming the ordinary image "1" that is formed first, the controller 100 starts that formation from the origin placement phase 310 of the photosensitive drum 210, and finishes that formation by the origin placement phase 310 of the third circumference. When forming the ordinary image "2" that is formed second, the controller 100 starts that formation from the origin placement phase 310 of the third circumference of the photosensitive drum 210, and finishes that formation by the origin placement phase 310 of the fifth circumference. This is likewise true for the ordinary image "3" and subsequent ordinary images.

FIGS. 4A to 4D illustrate, when forming a density correction image between two ordinary images in a so-called inter-image region, the relationship between placement phases and ordinary images and density correction images on the photosensitive drum 210. An inter-image region is, when ordinary images are continuously formed, a region from the end of a particular ordinary image to the start of the next ordinary image. In this example, the length in the sub-scanning direction of the density correction image is assumed to be the same as that length for the above-described ordinary image.

Figures 4A, 4B, 4C, 4D:
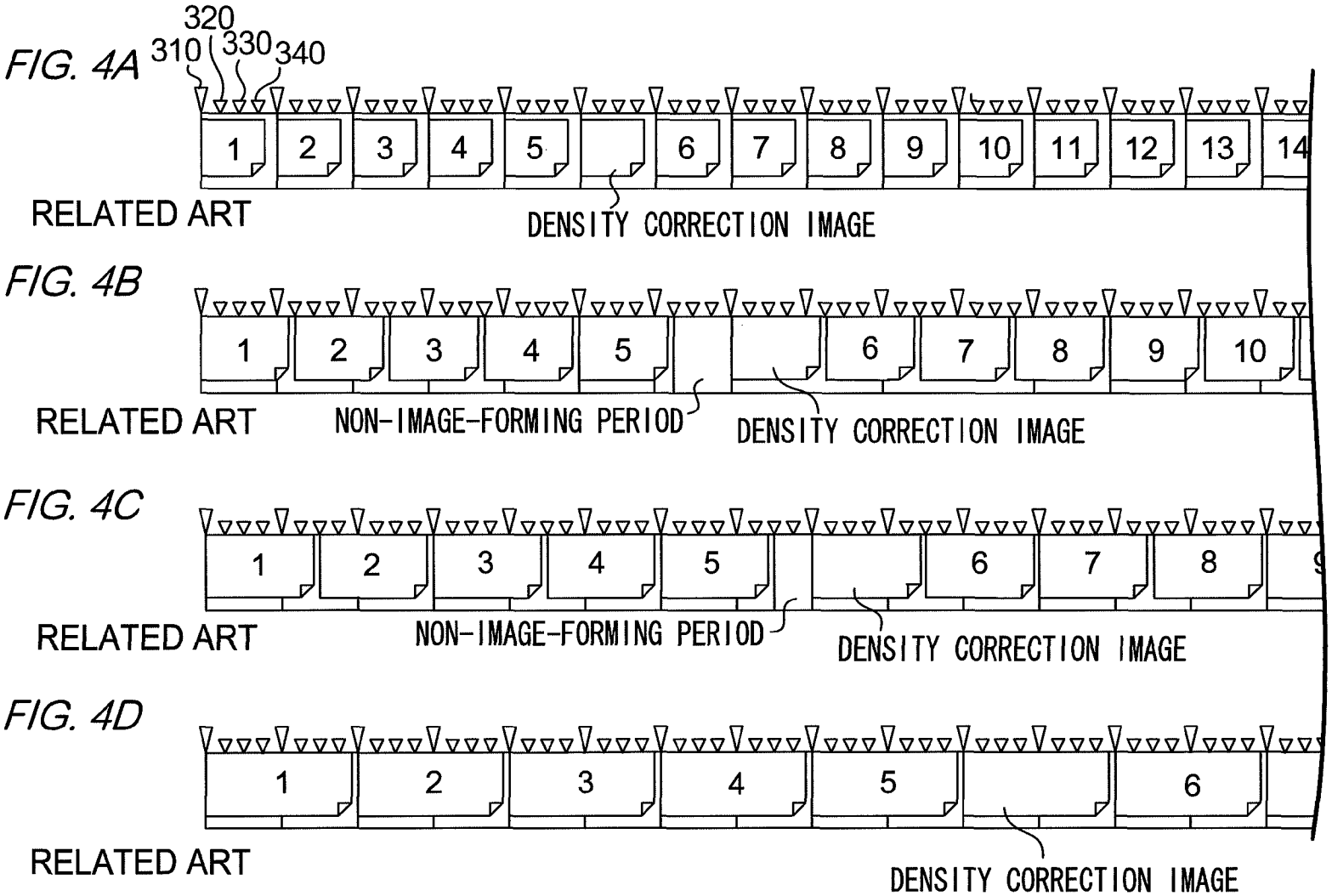
FIG. 4A RELATED ART
FIG. 4B RELATED ART
FIG. 4C RELATED ART
FIG. 4D RELATED ART
FIGS. 4A to 4D illustrate, when successively forming multiple images, the relationship between placement phases and images on a photosensitive drum.

FIG. 4A shows an example in which, when forming ordinary images at a 1 drum interval, a density correction image is formed in the inter-image region. Processing is repeated in which, when forming the ordinary image "1" that is formed first, the controller 100 starts that formation from the origin placement phase 310 of the photosensitive drum 210, and finishes that formation before the origin placement phase 310 of the next circumference. When the controller 100 forms the density correction image, as described above, it is necessary for the density correction image to be formed from the origin placement phase 310, and in this example, because a schedule is adopted in which an ordinary image is also formed from the origin placement phase 310, formation of the density correction image is also started from the origin placement phase 310, same as for the ordinary image, and finished before the origin placement phase 310 of the next circumference.

On the other hand, FIG. 4B shows an example in which, when forming ordinary images at a 1.25 drum interval, a density correction image is formed in the inter-image region. In this case as well, it is necessary to start formation of the density correction image from the origin placement phase 310, so when, for example, the controller 100 forms a density correction image in an inter-image region between an ordinary image "5" and an ordinary image "6", it is necessary to wait until arrival of the origin placement phase 310, so a period occurs in which an image is not being formed (a non-image-forming period). Such a non-image-forming period also occurs in the same manner in the case of a 1.5 drum interval as shown in FIG. 4C, but does not occur in the case of a 2 drum interval as shown in FIG. 4D. When such a non-image-forming period occurs, the total time needed to form one sequence of a group of ordinary images becomes longer, so there is a decrease in time efficiency related to image-forming.

In order to suppress such a decrease in time efficiency, the controller 100 performs the following sort of processing.

Figure 6:
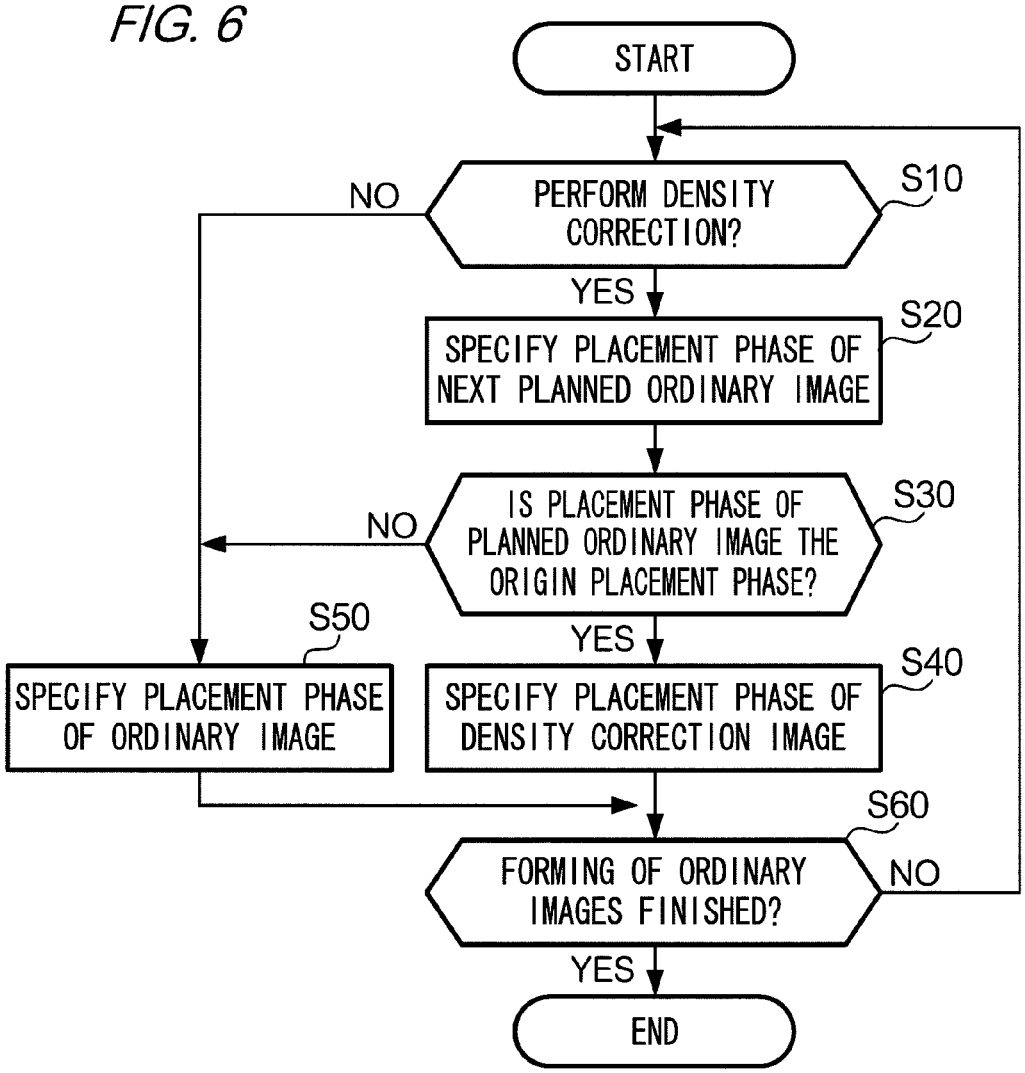
FIG. 6 is a flowchart that shows the operation of a controller.

FIGS. 5A to 5D illustrate the relationship between placement phases and ordinary images and density correction images on the photosensitive drum 210, and FIG. 6 is a flowchart that shows operation of the controller 100.

Figures 5A, 5B, 5C, 5D:
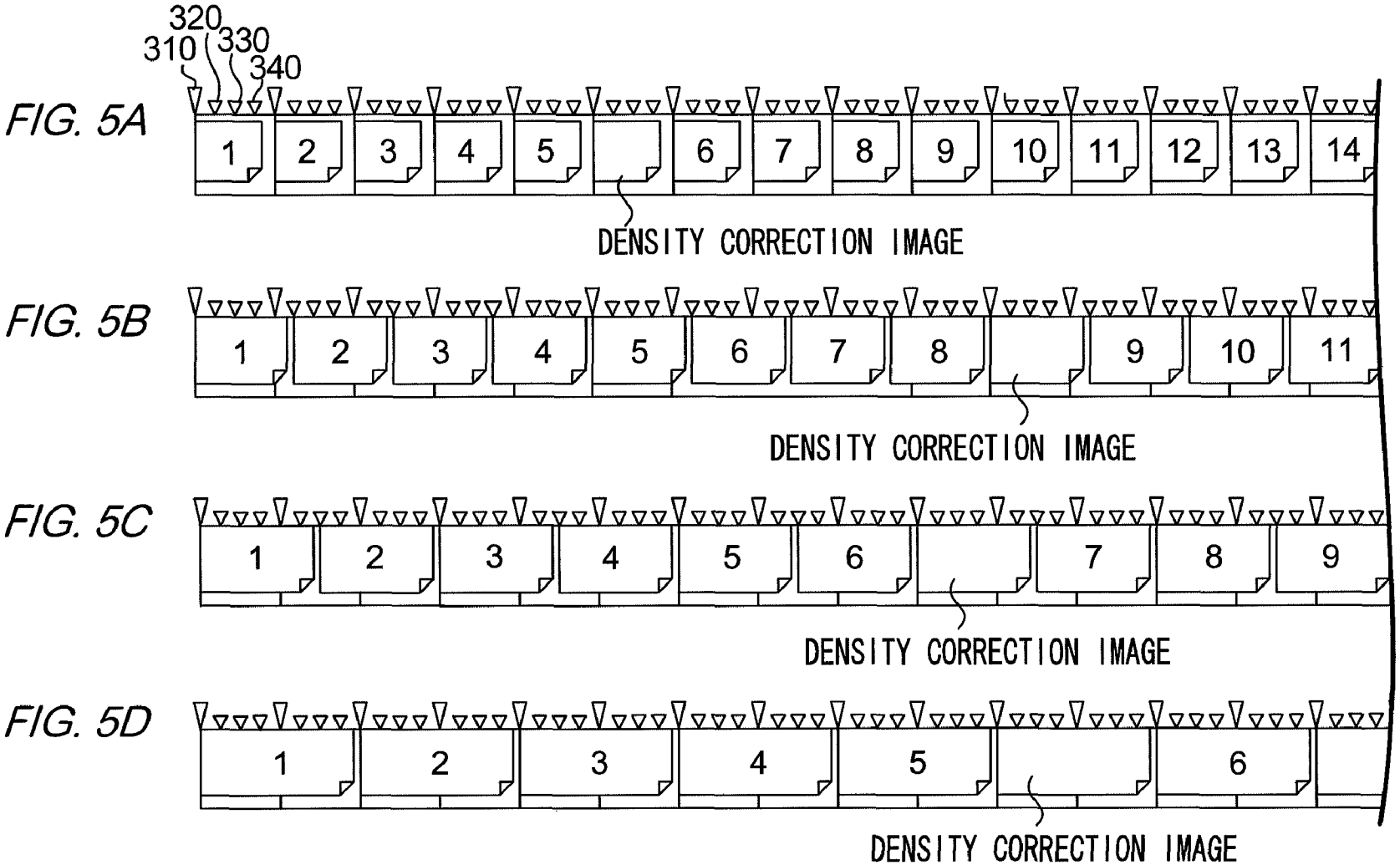
FIGS. 5A to 5D illustrate, when successively forming multiple images, the relationship between placement phases and images on a photosensitive drum.

FIG. 5A shows an example of forming a density correction image in the inter-image region when forming ordinary images at a 1 drum interval. First to fifth ordinary images "1" to "5" shown in FIG. 5A are formed with the same timing as the first to fifth ordinary images "1" to "5" illustrated in FIG. 4A, so a detailed description thereof is omitted here. Here, an example is described of a case in which the time when a density correction image is formed has arrived after finishing formation of the fifth ordinary image "5". The time when the density correction image is formed, for example, may arrive at each occurrence of a predetermined period, or may arrive at each occurrence of a predetermined image-forming amount, or may arrive in response to an instruction from a user of the image-forming apparatus.

First, the controller 100 judges whether or not the time for forming the density correction image has arrived (Step S10). Here, when the controller 100 judges that the time for forming the density correction image has arrived (Step S10; YES), the controller 100 specifies a placement phase where forming of the next planned ordinary image will start, based on an electrical signal from the phase sensor unit 300 (Step S20). The placement phase specified at this time, when stated according to the example in FIG. 5A, is the placement phase where formation of a sixth ordinary image "6" will be started, i.e., the origin placement phase 310. Next, the controller 100 judges whether or not the placement phase specified in Step S20 is the origin placement phase 310 (Step S30). Here, the controller 100 judges that the placement phase of the next planned ordinary image is the origin placement phase 310 (Step S30; YES), so the controller 100 determines that the density correction image will be formed from the origin placement phase 310 (Step S40). That is, the controller 100 determines that instead of forming the next planned ordinary image, formation of the density correction image will be started from the origin placement phase 310. Along with this determination, the image-forming unit 200 forms the density correction image.

Next, the controller 100 judges whether or not to end ordinary image formation (Step S60). Here, formation of the sixth and subsequent ordinary images is not yet completed, so the controller 100 judges that ordinary image formation is not finished (Step S60; NO), and returning to Step S10, the controller 100 judges whether or not to perform density correction. Here, the controller 100 judges not to perform density correction (Step S10; NO), and determines the placement phase where the sixth ordinary image "6" will be formed (Step S50). Thereafter, the above processing is repeated. When the controller 100 has judged in Step S60 to finish ordinary image formation (Step S60; YES), image-forming by the image-forming unit 200 ends.

Thus, in the example in FIG. 5A, formation of the density correction image is started from the position of the origin placement phase 310 after formation of the fifth ordinary image ends, so a non-image-forming period as illustrated in FIGS. 4B and 4C does not occur. This is also true when forming a density correction image in the case of forming ordinary images at a 2 drum interval, as in FIG. 5D.

Next, FIG. 5B shows an example of forming a density correction image in the inter-image region when forming ordinary images at a 1.25 drum interval. In FIG. 5B, an example is illustrated of a case in which the time when a density correction image is formed has arrived after finishing formation of the fifth ordinary image "5".

In FIG. 6, when the controller 100 judges that the time for forming the density correction image has arrived (Step S10; YES), the controller 100 specifies a placement phase where forming of the next planned ordinary image will start (Step S20). The placement phase specified in the example in FIG. 5B is the placement phase of the sixth ordinary image "6", and this is the second placement phase 320. Next, the controller 100 judges whether or not the placement phase specified in Step S20 is the origin placement phase 310 (Step S30). In the example in FIG. 5B, the controller 100 judges that the placement phase of the next planned ordinary image is not the origin placement phase 310 (Step S30; NO), so processing proceeds to Step S50, in which the controller 100 determines that the forming position of the sixth ordinary image "6" is the second placement phase 320, and ordinary image-forming is performed. Next, via the processing of Steps S60 and S10, the controller 100 again specifies the placement phase where formation of the next planned ordinary image will be started (Step S20). The placement phase specified in the example in FIG. 5B is the placement phase of a seventh ordinary image "7", and this is the third placement phase 330, so this placement phase also is judged to not be the origin placement phase 310 (Step S30; NO).

Next, via the processing of Steps S50, S60 and S10, the controller 100 again specifies the placement phase where formation of the next planned ordinary image will be started (Step S20). The placement phase specified in the example in FIG. 5B is the placement phase of an eighth ordinary image "8", and this is the fourth placement phase 340, so this placement phase also is judged to not be the origin placement phase 310 (Step S30; NO). Next, via the processing of Steps S50, S60 and S10, the controller 100 again specifies the placement phase where formation of the next planned ordinary image will be started (Step S20). The placement phase specified in the example in FIG. 5B is the placement phase of a ninth ordinary image "9", and the controller 100 judges this placement phase to be the origin placement phase 310 (Step S30; YES), and determines that instead of the ninth ordinary image "9", a density correction image will be formed from the origin placement phase 310 (Step S40). Thus, the controller 100 specifies the placement phase at which an ordinary image that is formed first from among the ordinary images included in a group of ordinary images will be formed at a time when it was judged to form a density correction image or thereafter, and when the specified placement phase is the origin placement phase 310, the controller 100 determines to start formation of a density correction image from the origin placement phase 310 instead of forming the ordinary image that is formed first. On the other hand, when the specified placement phase is not the origin placement phase 310, the controller 100 specifies an ordinary image formed earliest from the origin placement phase from among a group of ordinary images formed at a time when it was judged to form a density correction image or thereafter, and determines to start formation of a density correction image from the origin placement phase 310 instead of forming the specified ordinary image. That is, the time for formation of a density correction image is delayed until the arrival of the time for formation of an ordinary image from the origin placement phase 310, so a non-image-forming period as illustrated in FIGS. 4B and 4C does not occur.

FIG. 5C shows an example of forming a density correction image in the inter-image region when forming ordinary images at a 1.5 drum interval, and in this case as well, the position where a density correction image will be formed is determined with the same reasoning as stated above. Specifically, formation of a density correction image is started after finishing formation of the sixth ordinary image "6".

(3) Modifications

Modified Example 1

In this exemplary embodiment, the controller 100 delays the time for formation of a density correction image until arrival of the time for formation of an ordinary image that is formed from the origin placement phase 310, but when instructed to immediately perform density correction, even if the placement phase is other than the origin placement phase 310, a placement phase of the photosensitive drum 210 at which it is possible to form a density correction image in the shortest period from the time of that instruction may be determined to be the placement phase at which formation of a density correction image will be started.

Figure 7:
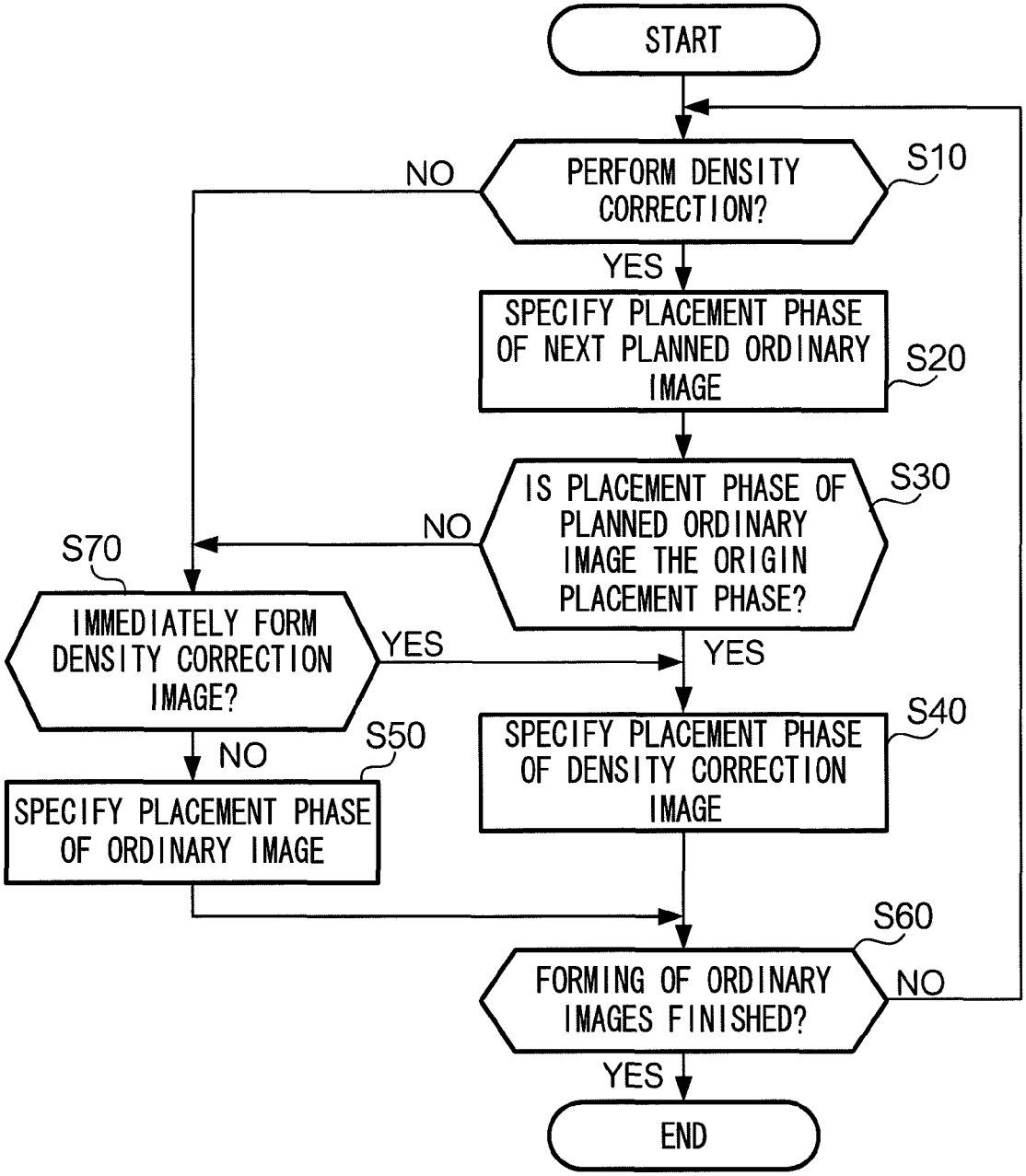
FIG. 7 is a flowchart that shows the operation of a controller according to a modified example.

FIG. 7 is a flowchart that shows operation of a controller 100 according to this modified example. In FIG. 7, the processing of Step S70 is added to the processing shown in FIG. 6. That is, when the placement phase of a planned ordinary image is not the origin placement phase 310 (Step S30; NO), the controller 100 judges whether or not to immediately form a density correction image (Step S70), and when a judgment has been made to immediately form a density correction image (Step S70; YES), the placement phase at which a density correction image will be formed is specified (Step S40).

Modified Example 2

The density sensor unit 400 according to this exemplary embodiment detects the density of a density correction image that has been transferred to the intermediate transfer belt 255, but this is not a limitation. For example, the density sensor unit 400 may detect the density of a density correction image that has been formed on the photosensitive drum 210, or may detect the density of a density correction image that has been transferred to a recording medium such as paper.

Modified Example 3

In this exemplary embodiment, the placement phases include four phases: the origin placement phase 310, the second placement phase 320, the third placement phase 330, and the fourth placement phase 340, but this is not a limitation on the number of placement phases. Also, the placement phase at which a density correction image is formed does not have to be one placement phase. When a high accuracy of density correction is not sought, or when a decrease in time efficiency due to delaying formation of a density correction image is not allowable, the number of placement phases at which a density correction image is formed may be at least one placement phase and less than the total number of placement phases.

Also, in this exemplary embodiment, there are four intervals at which images are formed: a 1 drum interval, a 1.25 drum interval, a 1.5 drum interval, and a 2 drum interval, but this is not a limitation.

Modified Example 4

The image-forming apparatus 1 according to this exemplary embodiment includes the photosensitive drums 210Y, 210M, 210C, and 210K, and developer of the colors yellow (Y), magenta (M), cyan (C), and black (K) is used, but this is not a limitation. For example, the image-forming apparatus may be configured such that developer of one color is used by one photosensitive drum.

Modified Example 5

The phase sensor unit 300 may be any sensor unit or the like that detects the amount of rotation of a photosensitive drum 210 with reference to a particular position on that photosensitive drum 210. Also, the amount of rotation stated here may be a value that indicates the amount that the photosensitive drum 210 has rotated, i.e., a rotation angle when the photosensitive drum 210 has rotated, the amount of movement of the surface of the photosensitive drum 210 when the photosensitive drum 210 has rotated, or the like.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

a forming unit that forms an image on an image holder that is a rotating body holding an image;

a measuring unit that measures a rotation amount of the image holder with reference to a certain position on the image holder;

a determining unit that:

identifies a position on the image holder from which an image is to be formed by the forming unit, according to the rotation amount measured by the measuring unit;

if, while a plurality of images are successively formed on the image holder, an image for density correction is to be formed, postpones forming of the image for density correction until a timing arrives at which one image of the plurality of images is to be formed from a predetermined position on the image holder, and when the timing arrives at which the one image of the plurality of images is to be formed from the predetermined position on the image holder, determines to start forming of the image for density correction from the predetermined position, instead of forming the one image of the plurality of images; and a correction unit that obtains a reading result of the image for density correction formed by the forming unit from the predetermined position, and corrects a density of at least one of the plurality of images on the basis of the obtained reading result, wherein:

if, while a plurality of images are successively formed on the image holder, a timing arrives at which the image for density correction is to be formed, the determining unit specifies a position on the image holder from which a first image of the plurality of images is to be formed after the timing, if the specified position is the predetermined position, the determining unit determines to start forming of the image for density correction from the predetermined position, instead of forming the first image, if the specified position is not the predetermined position, the determining unit specifies a second image, that is to be formed from the predetermined position earliest of the plurality of images to be formed after the timing, and determines to start forming of the image for density correction from the predetermined position, instead of forming the second image.

2. The image-forming apparatus according to claim 1, wherein:

if while a plurality of images are successively formed on the image holder, an instruction to immediately form the image for density correction is performed, the determining unit specifies a position on the image holder at which it is possible for the forming unit to form an image in the shortest period after the instruction performed, and determines to start forming the image for density correction from the specified position, even if the specified position is other than the predetermined position.

3. An image-forming method comprising:

forming an image on an image holder that is a rotating body holding an image;

measuring a rotation amount of the image holder with reference to a certain position on the image holder;

identifying a position on the image holder from which an image is to be formed, according to the measured rotation amount;

if, while a plurality of images are successively formed on the image holder, an image for density correction is to be formed, postponing forming of the image for density correction until a timing arrives at which one image of the plurality of images is to be formed from a predetermined position on the image holder, and when the timing arrives at which the one image of the plurality of images is to be formed from the predetermined position on the image holder, determining to start forming of the image for density correction from the predetermined position, instead of forming the one image of the plurality of images; and obtaining a reading result of the image for density correction formed from the predetermined position, and correcting a density of at least one of the plurality of images on the basis of the obtained reading result wherein:

if, while a plurality of images are successively formed on the image holder, a timing arrives at which the image for density correction is to be formed, the determining unit specifies a position on the image holder from which a first image of the plurality of images is to be formed after the timing, if the specified position is the predetermined position, the determining unit determines to start forming of the image for density correction from the predetermined position, instead of forming the first image, if the specified position is not the predetermined position, the determining unit specifies a second image, that is to be formed from the predetermined position earliest of the plurality of images to be formed after the timing, and determines to start forming of the image for density correction from the predetermined position, instead of forming the second image.

* * * * *